US007131823B2

(12) United States Patent
Kalavsky

(10) Patent No.: US 7,131,823 B2
(45) Date of Patent: Nov. 7, 2006

(54) ELECTRICALLY DRIVEN PUMP AND DOMESTIC APPLIANCE HAVING THE PUMP

(75) Inventor: Michal Kalavsky, Kosice (SK)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 11/123,455

(22) Filed: May 5, 2005

(65) Prior Publication Data

US 2006/0045776 A1 Mar. 2, 2006

Related U.S. Application Data

(63) Continuation of application No. PCT/EP03/12155, filed on Oct. 31, 2003.

(30) Foreign Application Priority Data

Nov. 5, 2002 (DE) ..... 102 51 461.5

(51) Int. Cl.
*F04B 17/03* (2006.01)

(52) U.S. Cl. ..... 417/356

(58) Field of Classification Search ..... 417/355, 417/356

See application file for complete search history.

(56) References Cited

U.S. PATENT DOCUMENTS

| | | | | |
|---|---|---|---|---|
| 2,293,508 | A * | 8/1942 | Killam | 417/356 |
| 3,853,429 | A | 12/1974 | Wiedenmann | |
| 4,699,573 | A | 10/1987 | Petrie et al. | |
| 5,209,650 | A | 5/1993 | Lemieux | |
| 6,302,661 | B1 * | 10/2001 | Khanwilkar et al. | 417/356 |
| 6,386,839 | B1 * | 5/2002 | Chuang | 417/356 |
| 6,443,715 | B1 * | 9/2002 | Mayleben et al. | 417/356 |
| 6,450,786 | B1 | 9/2002 | Koch et al. | |

FOREIGN PATENT DOCUMENTS

| | | |
|---|---|---|
| CH | 344 128 | 3/1960 |
| DE | 38 22 897 A1 | 1/1990 |
| DE | 199 03 817 A1 | 8/2000 |
| EP | 1 130 741 A2 | 9/2001 |
| FR | 2 608 228 | 6/1988 |
| GB | 1194228 | 6/1970 |
| GB | 1 406 155 | 9/1975 |
| GB | 2 066 899 A | 7/1981 |

* cited by examiner

*Primary Examiner*—Michael Koczo, Jr.
(74) *Attorney, Agent, or Firm*—Laurence A. Greenberg; Werner H. Stemer; Ralph E. Locher

(57) ABSTRACT

A pump includes a pump chamber in which an impeller and a rotor of an electric motor connected to the impeller are disposed. A flow path runs from an inlet to an outlet of the pump chamber through a central passage of the rotor. A domestic appliance having the pump is also provided.

20 Claims, 3 Drawing Sheets

ELECTRICALLY DRIVEN PUMP AND DOMESTIC APPLIANCE HAVING THE PUMP

CROSS-REFERENCE TO RELATED APPLICATION

This is a continuing application, under 35 U.S.C. § 120, of copending International Application No. PCT/EP2003/012155, filed Oct. 31, 2003, which designated the United States; this application also claims the priority, under 35 U.S.C. § 119, of German Patent Application 102 51 461.5, filed Nov. 5, 2002; the prior applications are herewith incorporated by reference in their entirety.

BACKGROUND OF THE INVENTION

Field of the Invention

The present invention relates to an electrically driven pump including an impeller rotating in a pump chamber. The invention also relates to a domestic appliance having the pump. Such pumps are used in a plurality of areas of application where liquids must be moved against a low counter-pressure, such as for example for circulating washing liquids in dishwashers or washing machines, as cooling water pumps for internal combustion engines and as bilge pumps for ships. etc.

Most pumps for liquids have a two-part structure including a motor which drives a shaft and a pump head driven by the shaft and connected to the motor in the longitudinal direction of the shaft. Such a configuration results in a pump structure that is elongated in the direction of the shaft, which is not well suited to all situations for building into appliances where such a pump is used. Thus, in a dishwasher, for example, a pump for circulating the washing liquid is generally located underneath the washing chamber. The overall height of the pump should be as low as possible so that the height of the washing chamber attainable with a pre-determined height of the dishwasher housing is not unnecessarily restricted. This means that the conventional pumps having an axially elongated structure must be installed with a horizontally oriented shaft. The overall height of such a pump can only be reduced by reducing the diameter of its rotating parts, which impairs the performance thereof.

A further disadvantage of the principle of the conventional structure is that the shaft leading to the pump head must be reliably sealed. That is required in order to protect the motor from liquid escaping from the pump head.

In order to solve the problem of sealing and at the same time cool the rotor of the electric motor, it was proposed in German Published, Non-Prosecuted Patent Application DE 199 03 817 A1, corresponding to U.S. Pat. No. 6,450,786 B1, that the impeller of a cooling water pump for a motor vehicle be made at least partly from a magnetic material which at the same time serves as the rotor of an electric motor driving the impeller. That pump certainly dispenses with a rotary shaft with rotary transmission between the electric motor and the pump head, but it does not allow any shortening of the overall length of the pump in the axial direction. Rather, that pump uses an impeller which is unusually elongated in the axial direction that can be divided with regard to its function into two sections in the axial direction. A first section dips deeply into a part of the pump chamber surrounded by the stator of the electric motor and, by being exposed to the stator field therein, functions as a rotor but displays scarcely any pumping action. A second section is barely detected by the stator field, but however is located at the height of the inlet and outlet of the pump chamber and thus almost exclusively displays pumping action. The structural principle mentioned initially as a result of which the motor and pump head are adjacent one another in the longitudinal direction of the shaft, is also adopted in that conventional pump.

SUMMARY OF THE INVENTION

It is accordingly an object of the invention to provide an electrically driven pump and a domestic appliance having the pump, which overcome the hereinafore-mentioned disadvantages of the heretofore-known devices of this general type and in which the pump has a reduced overall length in the axial direction compared with conventional pumps while the pumping capacity remains the same, and is thereby better suited to the installation conditions in certain appliances and allows a better usage of space as compared with conventional impeller pumps.

With the foregoing and other objects in view there is provided, in accordance with the invention, a pump, comprising a pumping chamber having an inlet and an outlet. An impeller is disposed in the pumping chamber. A rotor of an electrical machine is disposed in the pumping chamber and is connected to the impeller. The rotor has a central through-passage through which a flow path from the inlet to the outlet of the pumping chamber runs. A pump housing includes a first part and a second part. The first part of the pump housing has a cylindrical section with first and second ends, an inwardly directed shoulder bounding the inlet at the first end of the cylindrical section, and an outwardly directed shoulder at the second end of the cylindrical section. The second part of the pump housing forms a cover to be fitted to the second shoulder.

The functions of the pump head and the electrical drive can be achieved at the same height along the axis of the pump and the overall length of the pump in the axial direction can thereby be reduced, by providing a central passage through the rotor through which the flow path runs from the inlet to the outlet of the pump chamber of the pump.

In most conventional impeller pumps, the impeller has a hub from which the vanes project and the free ends of the vanes rotate along a stationary housing wall of the pump. In the pump according to the invention the flow path is not delimited by this housing wall but by a wheel flange which is part of the impeller and is connected to its hub through the vanes. This wheel flange bears the rotor of the electric motor.

The electric motor is preferably of the type excited by at least one permanent magnet, especially a brushless dc motor. The at least one permanent magnet of such a machine is preferably integrally surrounded by the wheel flange to protect it from contact with the liquid to be pumped. For this purpose, the wheel flange or preferably the entire impeller can be produced by insert-molding of the permanent magnet using a plastic material.

A stator of the electric motor is preferably disposed radially outside the rotor. One wall of the pump chamber then advantageously runs through a gap formed between stator and rotor.

In order to simplify assembly of the pump, the housing of the pump is preferably constructed of a first and a second part. The first part includes a cylindrical section, which can especially include the wall running through the gap between stator and rotor, an inwardly directed shoulder at a first end of the cylindrical section, which delimits the inlet, and an outwardly directed shoulder at a second end of the cylindrical section. The second part forms a cover which can be mounted on the second shoulder. The impeller can thus be inserted simply from the second end into the cylindrical section of the first housing part and enclosed therein by mounting the cover while the stator can be pushed on from the first side of the cylindrical section.

A holder for one end of a shaft of the impeller is advantageously formed on each of the two parts of the housing.

The fact that the impeller is directly connected to the rotor in the pump according to the invention allows both to be rotatably mounted on a stationary shaft.

The impeller is preferably mounted through the use of at least one sleeve bearing on the shaft in order to achieve low-friction suspension of the impeller. Such a sleeve bearing is advantageously fixedly connected to the impeller and rotatable about the stationary shaft. The impeller itself is thus exposed to no direct frictional loading and can therefore be made of an inexpensive material having a low friction loading capacity without this impairing the lifetime or service life of the pump.

At least one axial channel is provided on the inner surface of the sleeve bearing. The liquid pumped by the pump can penetrate into this channel, which on one hand cools the bearing and on the other hand promotes the formation of a friction-reducing liquid film between the inner surface of the sleeve bearing and the shaft.

The sleeve bearing advantageously has two sections having different outside diameters. A first section has a small outside diameter engaging in a central hole of the impeller and a second section has a larger outside diameter coming to lie outside the central hole and thus forming a stop which sets the axial position of the sleeve bearing on the impeller.

In order to achieve stable guidance, two sleeve bearings are preferably inserted into the central hole of the impeller from opposite ends. These two sleeve bearings are preferably identical.

The pump according to the invention is especially suitable for being installed in an appliance such as a dishwasher with a vertically oriented impeller axis. In this way, the pump only requires a small height inside an installation space underneath the washing chamber which can be kept as low as possible to allow for the washing chamber. The diameter of the pump according to the invention which is possibly increased compared with a conventional pump of the same capacity generally presents no problems in an installation space of this type having small vertical but large lateral dimensions.

If the pump is installed with a vertically oriented axis, it is also advantageous if the inlet is located higher than the outlet. When such a pump is operating, its impeller is exposed to a pressure of the pumped medium acting in the direction of the inlet so that if the inlet is elevated, axial forces acting on the bearings of the impeller caused firstly by this pressure and secondly by the weight of the impeller at least partly compensate for one another and thus the result is a smaller loading on the bearings.

In order to protect the holder which is subjected to axial loading during rotation of the impeller, from frictional wear, a washer is preferably attached rotationally fixedly at one end of the shaft and comes to lie between the holder and its neighboring rotating parts when the shaft is mounted. If the pump is operated at sufficient capacity, it can be assumed that the compressive force acting in the direction of the inlet exceeds the force of the impeller weight regardless of the installation position, so that the end of the shaft at which the washer is attached will preferably be the inlet-side end of the shaft.

Other features which are considered as characteristic for the invention are set forth in the appended claims.

Although the invention is illustrated and described herein as embodied in an electrically driven pump and a domestic appliance having the pump, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
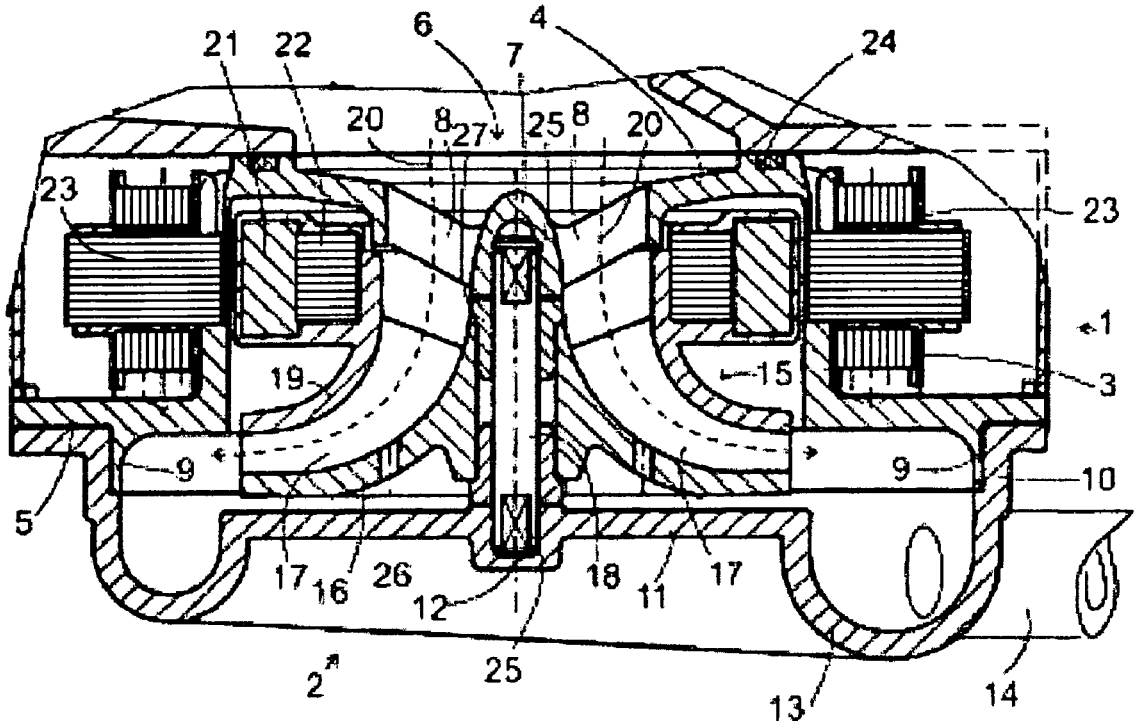
FIG. 1 is a fragmentary, diagrammatic, axial-sectional view of a pump according to a first embodiment of the invention.

Referring now to the figures of the drawings in detail and first, particularly, to FIG. 1 thereof, there is seen a housing of a pump which is composed of two parts 1, 2 that are manufactured in one piece, for example by injection molding from plastic. The first housing part 1 has a cylindrical section 3 with two ends. The cylindrical section 3 has a shoulder 4 extending radially inwardly and a shoulder 5 extending radially outwardly, relative to an axis of the cylindrical section 3. The second part 2 of the pump housing forms a cover to be fitted to the second shoulder 5. The shoulders 4, 5 are molded onto the two ends of the cylindrical section 3. The inwardly extending shoulder 4 delimits an inlet opening 6 of the pump. A first holder or socket 7 is disposed at the center of this inlet opening 6. The holder 7 is provided for a shaft 18 and is held by struts 8 which connect the holder 7 to the inwardly directed shoulder 4.

A circumferential rib 9 which is concentric to the axis is formed on a side of the outwardly directed shoulder 5 facing away from the cylindrical section 3. The rib 9 has an inner surface uniformly curved to a quadrant and a cylindrical outer surface on which a cylindrical outer wall 10 of the second housing part 2 is positioned. A second holder or socket 12 for an opposite end of the shaft 18 is provided in a flat bottom 11 of the housing part 2. The bottom 11 and the outer wall 10 are interconnected by a circumferential channel 13. The channel 13 has a free cross-section which is largest at the height of an outlet connecting piece 14 emerging from the channel 13. The free cross-section starts from the height of the outlet connecting piece 14 and decreases uniformly in both directions to a diametrically opposite point of the channel 13.

The bottom 11, the cylindrical section 3 and the inwardly directed shoulder 4 delimit a cylindrical pump chamber in which an impeller 15 is held rotatably about the shaft 18.

The impeller 15 has, in a known manner, a hub 16 in the form of a hyperboloid of revolution or a cone having an aperture angle becoming increasingly narrower towards the apex, i.e., towards the inlet opening 6. The hub 16 bears a plurality of vanes 17, each extending in a plane running through the longitudinal axis of the pump. The hub 16 has an axial hole with a diameter greater than that of the shaft 18, which runs therethrough and is held in the holders 7, 12.

Figure 3:
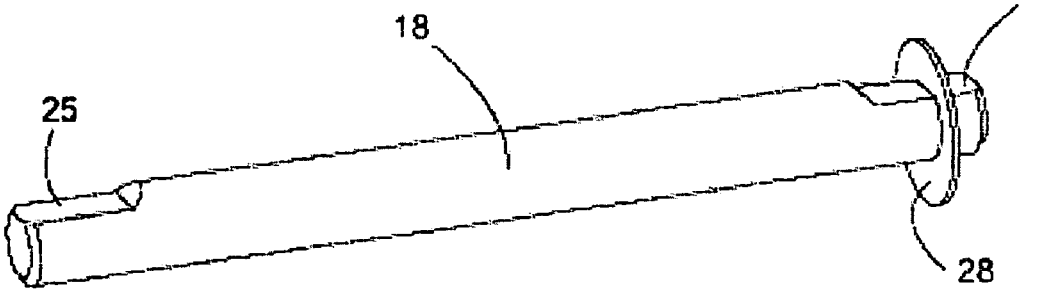
FIG. 3 is a perspective view of a shaft of the pump.

The shaft 18 is shown in a perspective view in FIG. 3. The shaft 18 has the shape of a substantially cylindrical metal rod provided with axially parallel flattened sections 25 at both of its ends, which impart an out-of-round cross section to the ends. The holders 7, 12 are each formed complementary to this out-of-round cross-section so that the shaft 18 is held rotationally fixedly in the pump housing. A metal washer 28 is pushed loosely onto one of the ends of the shaft 18. The washer has a central opening having a shape complementary to the flattened end of the shaft 18 so that it can be displaced over the axial extension of the flattened section 25 but cannot be rotated.

Figure 2:
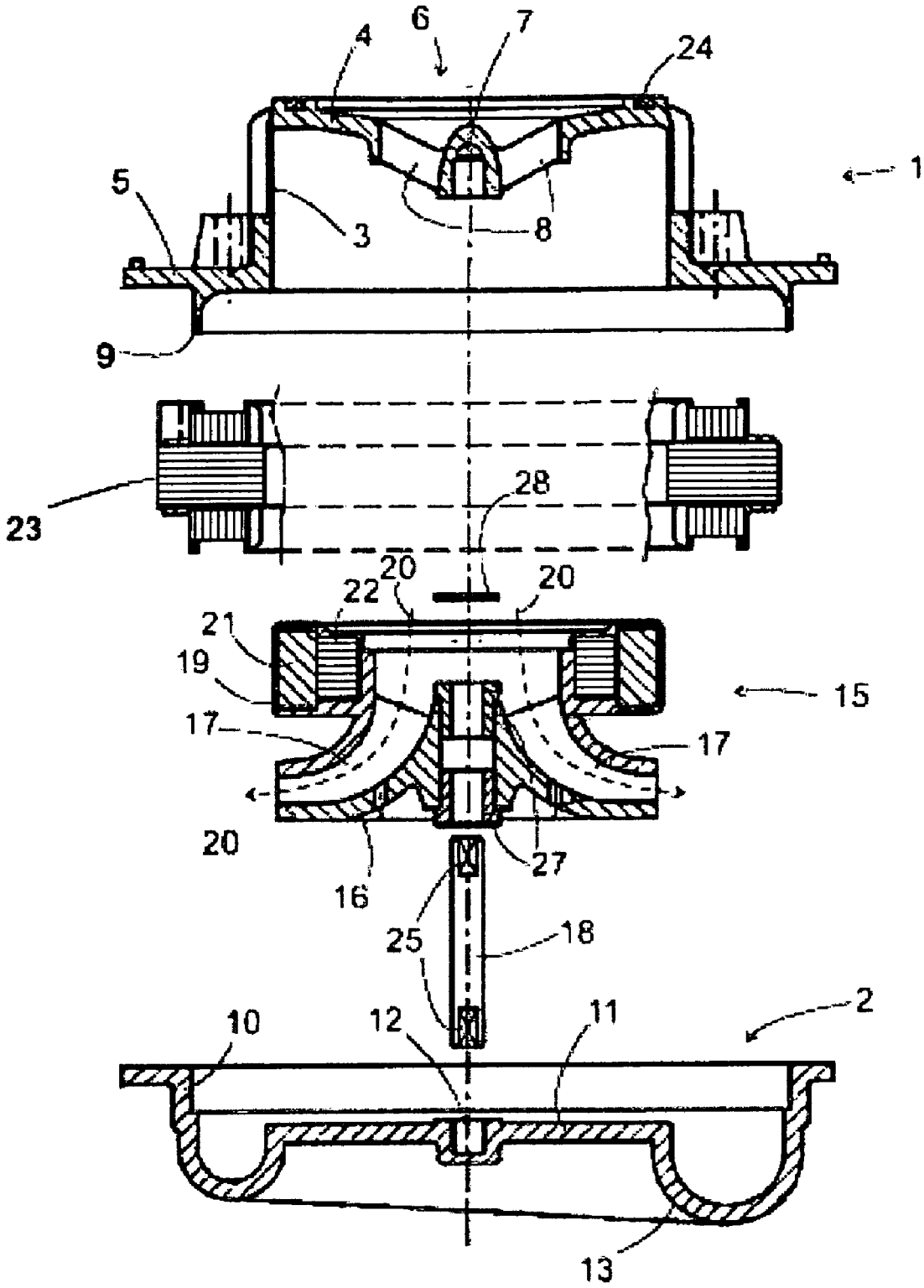
FIG. 2 is an exploded view showing individual parts of the pump.
Figure 4:
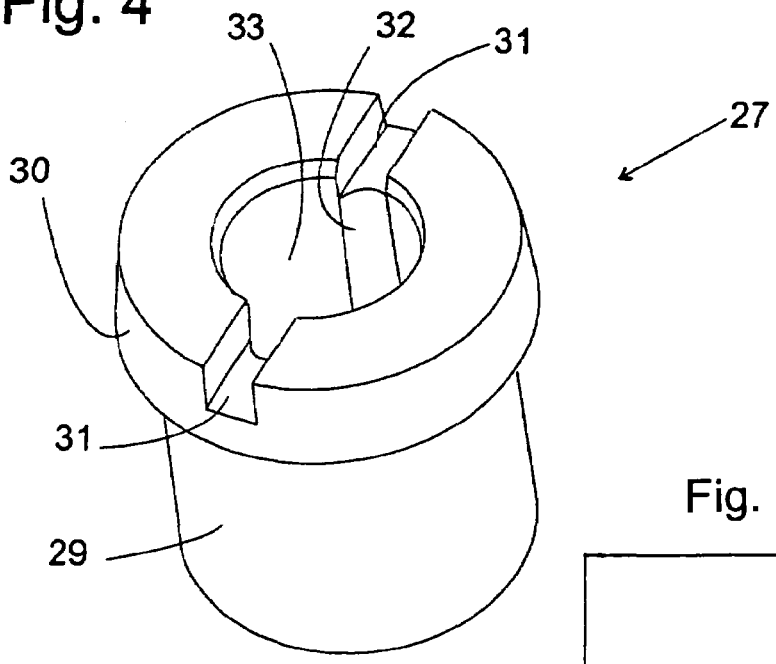
FIG. 4 is a perspective view of a sleeve bearing of the pump.

The impeller 15 is held on the shaft 18 with the aid of two identical sleeve or annular bearings 27 of which one is shown in a perspective view in FIG. 4. The sleeve bearing 27 is a one-part metal sleeve. The sleeve bearing has first and second successive sections 29, 30 in the axial direction, which are connected through a radial shoulder (facing away from the observer in FIG. 4). The outside diameter of the narrower first section 29 is dimensioned in such a way that it can be pressed into the axial hole of the hub 16, while the second section 30 projects over the hub 16 in the axial direction, as shown in FIG. 2. The sleeve bearing 27 has a central hole with an inside diameter that is slightly larger than the outside diameter of the shaft 18, defining a clearance between the two being dimensioned in such a way that a film of the liquid to be pumped can form between the two when the pump is operating. Penetration of liquid between the sleeve bearing 27 and the shaft 18 is aided by two radial slits 31 formed on the front of the second section 30 and each opening onto a channel 32, which extends over an inner surface 33 defined by the hole in the axial direction.

The vanes 17 of the impeller 15 carry a wheel flange 19 which is curved in a similar manner to the surface of the hub 16 and together therewith delimit a flow channel 20. The flow channel 20 initially runs from the inlet opening 6 axially downwards before bending increasingly further in the radial direction and finally emerging from the impeller 15 onto its circumferential surface and reaching the channel 13.

A permanent magnet 21 and a sheet-metal packing 22 are embedded in the wheel flange on the side of the wheel flange 19 facing the inlet opening 6 where the flow path 20 does not yet diverge in the radial direction. The magnet 21 and the sheet-metal packing 22 form a ring through which the flow path 20 runs. A rim of electromagnets 23 is disposed around this ring. The permanent magnet 21 and the electromagnets 23 form a rotor or a stator of a brush-less, electronically commutated dc motor. The rotor 21, 22 has a central through-passage defining the flow path 20. The cylindrical section 3 of the first housing part 1, which only has a thickness of fractions of a millimeter at the height of these magnets, and a thin layer of the wheel flange 19 including the permanent magnet 21, extend through an air gap between permanent and electromagnets.

The wheel flange 19 is surrounded all the way around by the liquid flowing through the pump. Since the permanent magnet 21 and the sheet-metal packing 22 are closely insert-molded by the material of the wheel flange 19, they are protected from the liquid. The electromagnets 23 are separated from the liquid by the one-part sealed wall of the first housing part 1. There is no rotary transmission which could become leaky in the course of operation and could allow liquid to be pumped to penetrate to the current-carrying parts of the pump. The only seals required on the pump according to the invention are those between the two housing parts 1, 2. The seals can be produced, for example, by adhesion, ultrasound welding or the like, between the first housing part 1 and a connection of an intake pipe, in this case provided by an elastomer sealing ring 24 embedded in a groove of the housing part 1, and between the outlet connecting piece 14 and a non-illustrated pipe connected thereto. No parts which can move relative to one another are present at any of these seals which suggests that good long-term stability can be expected.

Figure 5:
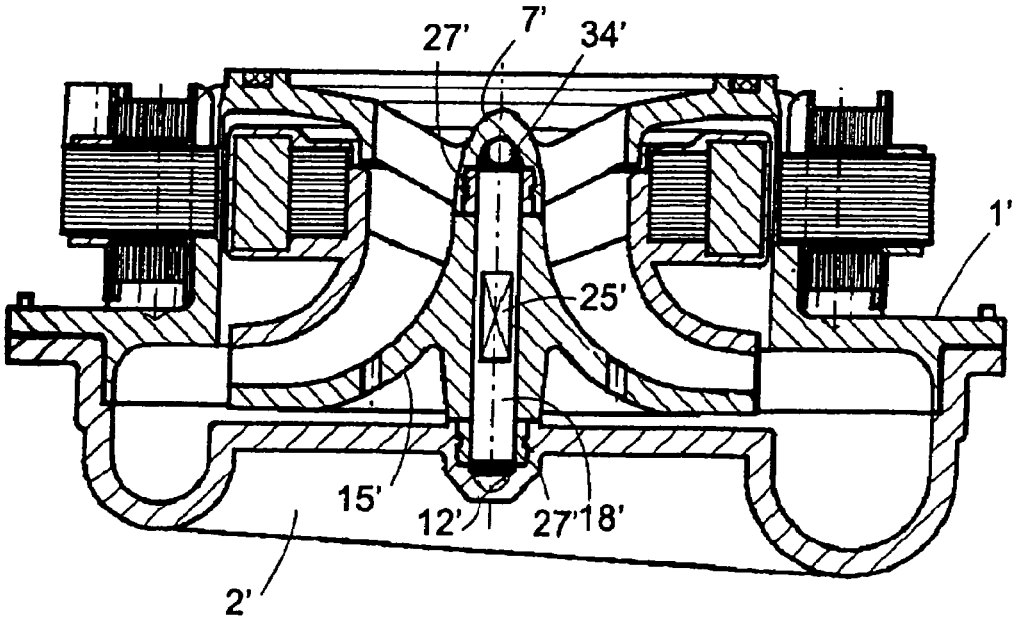
FIG. 5 is an axial-sectional view of a second embodiment of the pump of the invention.

FIG. 5 shows an axial section similar to FIG. 1 through a pump according to a second embodiment of the invention. This second embodiment is distinguished by a somewhat simpler structure with a reduced number of parts. It differs from the exemplary embodiment described above with respect to the suspension of the impeller. According to FIG. 5, an impeller 15' is fixedly and form-lockingly molded onto a shaft 18' and specifically by providing the shaft 18' with a central flattened section 25' and insert-molding with a hub of the impeller 15'. As a result of the form-locking connection, the shaft 18' rotates with the impeller 15' and is in each case rotatably received in bearing sections 7', 12' of two housing parts 1', 2'. A form-locking connection is one which connects two elements together due to the shape of the elements themselves, as opposed to a force-locking connection, which locks the elements together by force external to the elements.

Sleeve bearings 27' are each inserted into a respective one of the bearing sections 7', 12' to hold the shaft 18' in such a way that it can rotate. In order to reduce the rotational friction under axial loading, a ball 34' which is incorporated in the upper bearing section 7' can rotate both relative to the bearing section 7' and relative to the shaft 18'. When the impeller 15' loads the bearing section 7' as a result of the pressure acting on its back side, the ball 34' is clamped between the bearing section and the end of the shaft 18'. A corresponding ball could also be provided between the bearing section 12' and the shaft 18' or, as indicated in FIG. 5, the shaft 18' can simply only be tapered at its end which engages in the bearing section 12', as shown by the hemispherical contour in FIG. 5. Thus, the contact surface between the shaft 18' and the bearing section 12' is substantially restricted to a point lying on the axis of rotation.

This embodiment is suited for simplified assembly since the housing parts 1', 2' each with their sleeve bearings 27' and the impeller 15' with its shaft 18' can each be conveniently pre-assembled and need only be inserted into one another when the pump is assembled. However, the embodiment shown in FIGS. 1 to 4 is better suited for high stresses since this allows effective cooling and lubrication of the sleeve bearings by the pump liquid penetrating therein.

Figure 6:
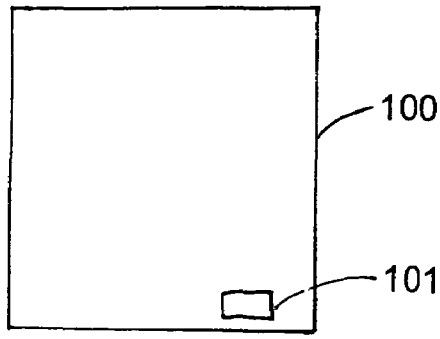
FIG. 6 is a diagrammatic view of the pump disposed in a dishwasher or household appliance.

FIG 6. shows that the pump 100 is disposed in a dishwasher or household appliance 101.

I claim:

1. A pump, comprising:

a pumping chamber having an inlet and an outlet;

an impeller disposed in said pumping chamber;

a rotor of an electrical machine, said rotor being disposed in said pumping chamber and being connected to said impeller, said rotor having a central through-passage through which a flow path from said inlet to said outlet of said pumping chamber runs;

a pump housing including a first part and a second part;

said first part of said pump housing having a cylindrical section with first and second ends, an inwardly directed shoulder bounding said inlet at said first end of said cylindrical section and being configured in a funnel-shape directed toward said inlet, and an outwardly directed shoulder at said second end of said cylindrical section; and said second part of said pump housing forming a cover fitted to said outwardly directed shoulder.

2. The pump according to claim 1, which further comprises a shaft for said impeller, each of said first and second parts of said pump housing having a respective socket for a respective end of said shaft.

3. The pump according to claim 1, which further comprises a stationary shaft, said rotor and said impeller being rotatable about said stationary shaft.

4. The pump according to claim 3, which further comprises at least one annular bearing mounting said impeller on said shaft, said at least one annular bearing rotating with said impeller.

5. The pump according to claim 4, wherein said at least one annular bearing has an inner surface with at least one axial channel.

6. The pump according to claim 4, wherein said at least one annular bearing has a first section engaging in a central hole in said impeller, and a second section disposed outside said central hole in said impeller and having an outside diameter greater than an outside diameter of said first section.

7. The pump according to claim 4, wherein said at least one annular bearing is two annular bearings inserted into a central hole in said impeller from opposite ends.

8. The pump according to claim 3, which further comprises a washer fitted to an inlet-side end of said shaft and rotating with said shaft.

9. The pump according to claim 2, wherein said impeller has a hub, and said shaft has a flattened middle portion and is molded with said hub of said impeller, for firmly and form-lockingly connecting said impeller on said shaft.

10. The pump according to claim 9, which further comprises bearing sections of each of said two housing parts, said shaft being rotatably held in said bearing sections, and annular bearings inserted into said bearing sections for rotatably holding said shaft.

11. The pump according to claim 10, which further comprises a ball incorporated in at least one of said bearing sections, said ball being rotatable both relative to said bearing section and relative to said shaft, and said ball being clamped in between said bearing section and an end of said shaft.

12. The pump according to claim 10, wherein said bearing sections include a lower bearing section, and said shaft is tapered at an end engaging in said lower bearing section for limiting a contact area between said shaft and said lower bearing section substantially to a point located on said rotary shaft.

13. The pump according to claim 2, wherein said rotary shaft of said impeller is oriented vertically in an installation position of the pump.

14. The pump according to claim 1, wherein said inlet is positioned above said outlet.

15. In combination with a domestic appliance, a pump according to claim 1.

16. In combination with a dishwasher, a pump according to claim 1.

17. The pump according to claim 1, wherein said cylindrical section has a longitudinal axis and said outwardly directed shoulder has a side facing away from said cylindrical section, said side of said outwardly directed shoulder has a circumferential rib formed thereon that is concentric to said longitudinal axis.

18. The pump according to claim 17, wherein said rib has a cylindrical outer surface on which a cylindrical wall of said second housing part is positioned.

19. The pump according to claim 1, wherein said second housing part has a bottom and a cylindrical outer wall that are interconnected by a circumferential channel, said channel has an outlet connecting piece emerging from therefrom, said outlet connecting piece has a height.

20. The pump according to claim 19, wherein said channel has a free flow cross-section that starts from said height of said outlet connecting piece and decreases uniformly in both directions to a diametrically opposite point of the channel.

* * * * *